United States Patent [19]

Kettlestrings

[11] Patent Number: 4,563,796

[45] Date of Patent: Jan. 14, 1986

[54] RETAINER WITH COACTING LEGS

[75] Inventor: John S. Kettlestrings, 2235 Stonegate La., Wheaton, Ill. 60187

[73] Assignees: John S. Kettlestrings, Wheaton, Ill.; A. Edward Maass, Minneapolis, Minn.

[21] Appl. No.: 551,039

[22] Filed: Nov. 14, 1983

[51] Int. Cl.[4] ..... F04B 10/00

[52] U.S. Cl. ..... 24/563; 24/555; 40/23 R; 40/23 A

[58] Field of Search ..... 40/23 A, 23 R; 24/555, 24/563, 547, 545, 564, 30.5 R

[56] References Cited

U.S. PATENT DOCUMENTS

| | | | |
|---|---|---|---|
| 2,089,333 | 8/1937 | Bourdon | 40/23 A |
| 2,292,272 | 8/1942 | Hirshfield | 40/23 R |
| 2,522,028 | 9/1950 | Felix | 40/23 R |
| 2,600,825 | 6/1952 | Aigner | 40/23 A |

FOREIGN PATENT DOCUMENTS

| | | | |
|---|---|---|---|
| 125952 | 12/1901 | Fed. Rep. of Germany | 24/555 |
| 556298 | 7/1923 | France | 24/555 |
| 454330 | 8/1950 | Italy | 24/555 |
| 95646 | 8/1922 | Switzerland | 24/555 |

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A retainer for sheet material is provided which is formed of resilient memory type material and which has two oppositely acting and opposed legs which provide a gripping action therebetween. Provision is made for one of the legs to act as an indicia carrying surface and a back surface of the retainer can be adapted to be adhesively mounted on a flat surface.

9 Claims, 12 Drawing Figures

RETAINER WITH COACTING LEGS

BACKGROUND OF TH INVENTION

1. Field of the Invention

The present invention relates to retainers or clamps and more particularly to devices for retaining sheets of material in fixed relationship relative to the retainer.

2. Description of the Prior Art

Commonly used retainers for securing sheets of material include the well known paper clip and the staple. While those devices provide an inexpensive means of holding two or more pieces of sheet material together, they each have some inherent undesirable qualities. For example, the staple destroys the integrity of the sheet by piercing a hole through the sheet and therefore is undesirable in some applications. Further, special tools are required for removing the staples in order to avoid destruction or mutilation of the sheets.

Undesirable qualities of the paper clip include the loss of memory of the clip over time, especially if the clip is made of plastic. Also, the clips generally have a single function, that is the retaining of the sheets, and cannot be used for any additional function such as carrying indicia markings or providing for attachment of the clip to a surface.

SUMMARY OF THE INVENTION

The present invention provides for a low cost retainer made of an elastic memory material and having two legs acting in opposite directions to provide two gripping areas.

The retainer can be formed in continuous strip form with the legs formed in a first "open" orientation. The retainer is then manipulated so that the legs are positioned in a "closed" orientation so as to act against each other to provide the separate gripping areas. A back portion connecting the two legs can be provided with an adhesive material so that the retainer can be attached to a wall, folder or other flat surface. The retainers can be made in any desirable width and a face is provided across the width of one of the legs which can be an indicia bearing surface providing a space for a user to make appropriate markings and designations.

With the two legs acting against each other, the problem of loss of memory present in prior retainers is significantly reduced since as one leg begins to relax, the other leg follows that movement and continues to hold the material between the legs.

DESCRIPTION OF THE PREFERRED EMBODIMENTS

Figure 1:
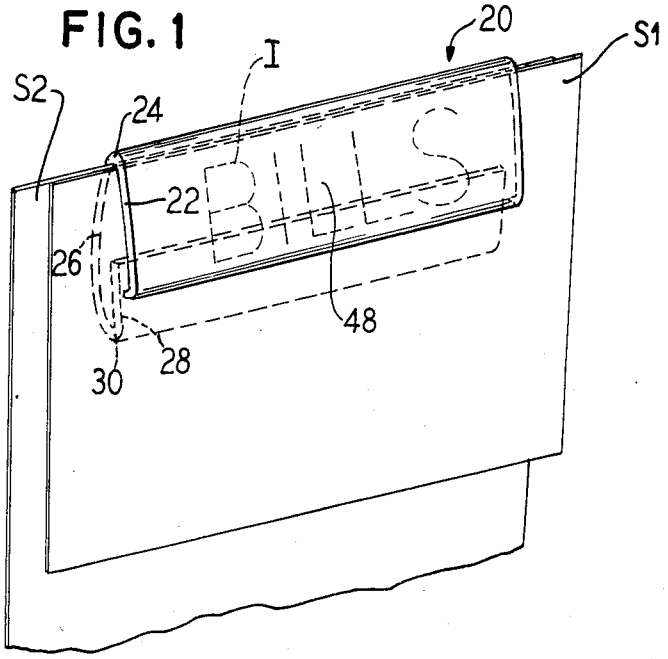
FIG. 1 is a perspective view of a retainer embodying the principles of the present invention.
Figure 2:
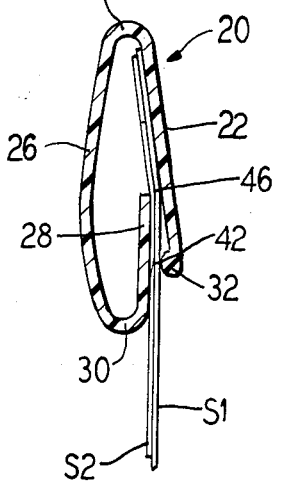
FIG. 2 is a side sectional view of one embodiment of the retainer.

In FIG. 1 there is seen a retainer generally at 20 which is being used to secure sheets of material S1 and S2. As also seen in FIG. 2, the retainer 20 has a body which is comprised of a flat rectangular first leg segment 22 connected through a bight 24 to a flat rectangular back segment 26 and a flat rectangular second leg segment 28 connected through a bight 30 to the back 26. In the "closed" configuration shown in FIGS. 1 and 2 the first leg 22 extends beyond and overlaps a portion of the second leg 28. An end of the first leg 22 can be provided with a rounded and enlarged terminus or lip 32 which engages with a portion of the second leg 28.

The retainer 20 is to be fabricated of a resiliant and flexible memory type material such that the parts of the retainer 20 will return to their original fabricated positions upon removal of a force deflecting them from those positions.

Figure 5:
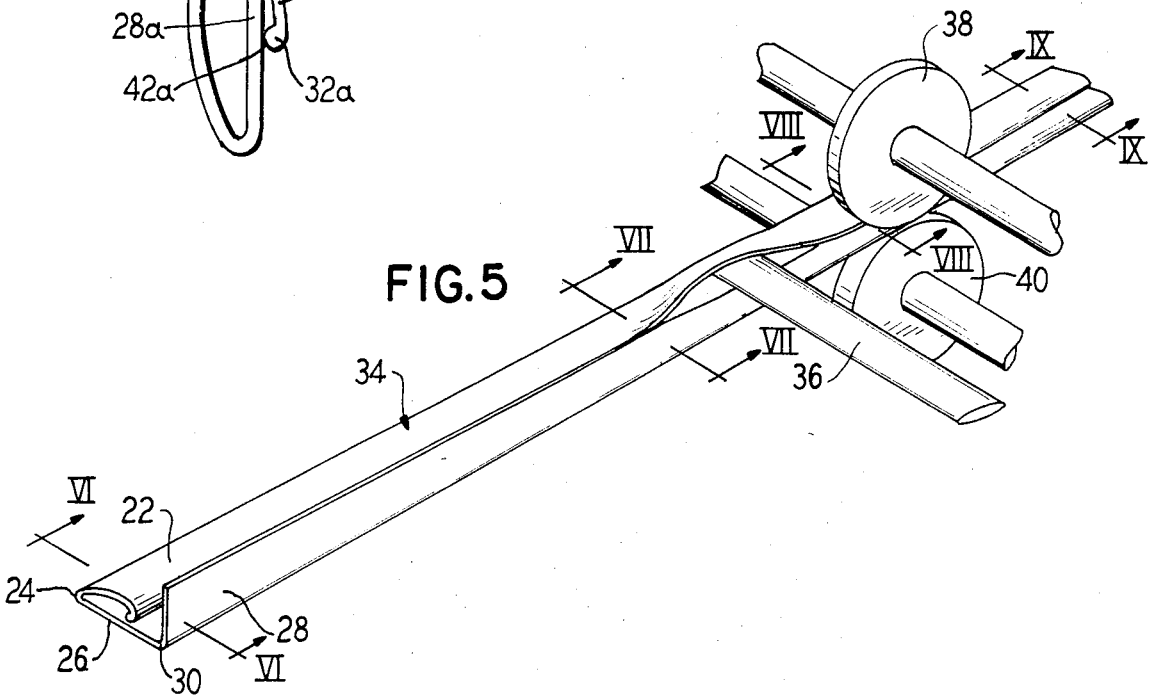
FIG. 5 is a perspective view of the manufacturing process of the retainer strip.
Figure 6:
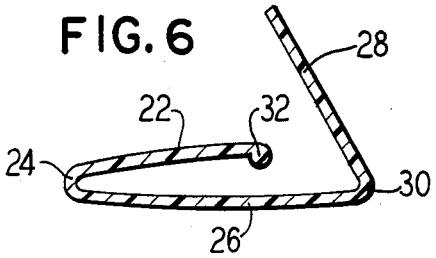
FIG. 6 is an end view of the retainer strip during the manufacturing process taken generally along the lines VI—VI of FIG. 5.

As seen in FIGS. 5 and 6, the retainer can be made from a continuous strip of material running the width of the retainer 20. The initial position of the legs 22 and 28 and back 26 of the retainer are shown in FIG. 6. These positions are formed in the initial fabrication of the retainer strip 34 as it is molded or extruded in the case of plastic type retainers or as it is formed with metal retainers. Thus, the memory of the material will urge the two legs 22 and 28 toward the positions shown in FIG. 6 upon the removal or lessening of any force acting against those legs causing them to deviate from the "open" position shown.

Figure 7:
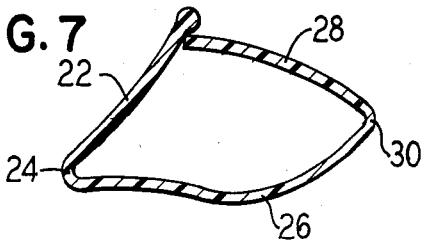
FIG. 7 is a sectional view of the retainer strip in the manufacturing process taken generally along the lines VII—VII of FIG. 5.
Figure 8:
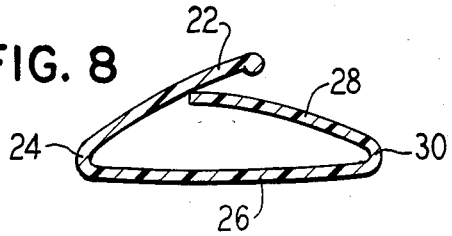
FIG. 8 is a sectional view of the retainer strip during the manufacturing process taken generally along the lines VIII—VIII of FIG. 5.

As seen in FIGS. 5 and 7, the legs are deviated from the positions shown in FIG. 6 by means of the strip 34 moving past a stationary tool 36 which lifts leg 22 and depresses leg 28 causing leg 28 to be folded under leg 22 in a "closed" position. After the second 28 has been folded under the first leg 22, the strip proceeds toward a pair of rollers 38, 40 and, as is seen in FIG. 8, the first leg 22 overlaps the second leg 28 to a greater degree.

Figure 9:
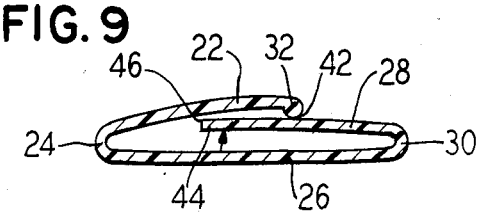
FIG. 9 is a sectional view of the retainer strip during the manufacturing process taken generally along the lines IX—IX of FIG. 5.

The rollers are provided to adjust and set the crease of bight 30 to provide a more flattened retainer as is shown in FIG. 9. After the strip has passed the rollers, the individual retainers can be cut off in any desired length. In the configuration of the retainer as shown in FIG. 9, the initial bias of the legs causes the first leg 22 to be biased against the second leg 28 and also the second leg 28 is biased against the first leg 22. Thus, the legs are acting against each other along two grip areas, one coinciding with the enlarge rounded end of the first leg 22 where it overlies and presses against the second leg 28 at 42, and a second area at an end 44 of the second leg where it presses up against the first leg 22 at 46. Thus, referring back to FIG. 2, the sheets S1 and S2 are secured by the retainer 20 along areas 42 and 46, the entire width of the retainer 20.

As seen in FIG. 1, the first leg 22 has a large relatively flat outer surface 48 which can act as an indicia bearing surface. Various indicia markings could be placed on this surface either by printing methods during the manufacture of the retainers or by appropriate marking utensils by the user as desired. Further, the retainers 20 can be fabricated in a variety of colors which could be utilized by the user to signify various types of sheet materials being retained.

Figure 3:
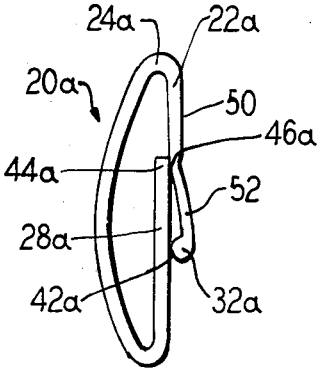
FIG. 3 is a view of an alternative embodiment of the retainer.

FIG. 3 shows an alternative embodiment of the retainer in which the first leg 22 has two separate sections, 50 and 52. Section 52 which is a portion of the leg including the rounded terminus 32*a* is formed with a reduced thickness compared to the thickness of section 50 which is a portion including the bight 24*a*. Thus the gripping action at area 42*a* between the terminus 32*a* of leg 22*a* and the second leg 28*a* is less than the gripping action at area 46*a* between the end 44*a* of the second leg 28*a* and the first leg 22*a*. The boundary line between the two sections 50 and 52 corresponds approximately with the gripping area 46*a*.

With this embodiment, the reduced gripping action at area 42*a* allows easy entry of the sheet material into the retainer. As the material is inserted further into the retainer past gripping area 46*a*, high gripping pressure is engaged because the thicker material of section 50 gives greater rigidity. Both legs 22*a* and 28*a* continue to work against each other to secure the material held by the retainer.

Figure 4:
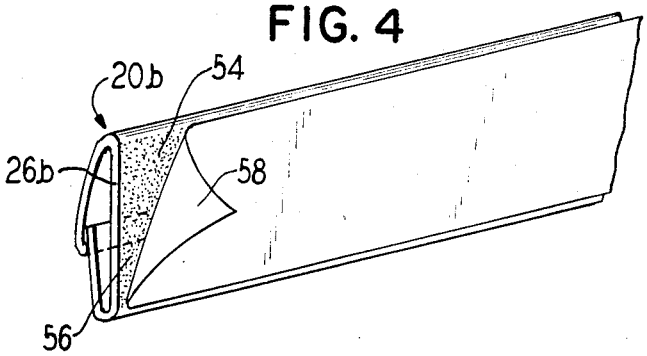
FIG. 4 is a back perspective view showing an optional adhesive layer.

A further embodiment of the invention is shown in FIG. 4 where it is seen that the back 26*b* of the retainer 20*b* is formed so as to present a planar surface 54 which can lay flat against other planar surfaces such as walls or file jackets. An adhesive material 56 may be applied to the back during the manufacturing process and a protective covering 58 can be applied over the adhesive to be removed by the user if is desired to secure the retainer 20*b* to a flat surface. The sheets of material held by the retainer will then be held flat against that surface.

Figure 10:
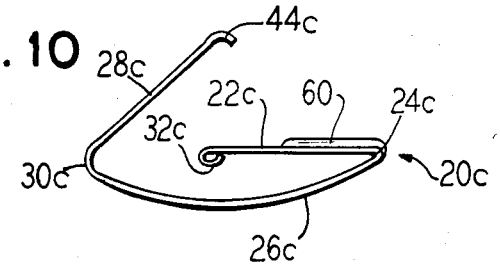
FIG. 10 is an end view of an alternative embodiment of the present invention in the "open" position.
Figure 11:
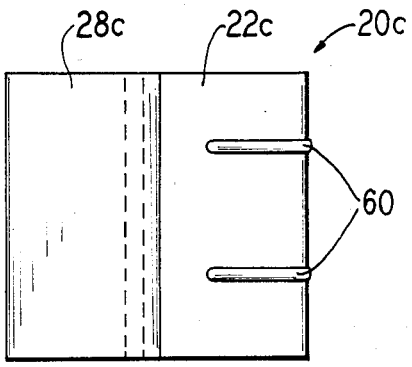
FIG. 11 is a top plan view of the retainer shown in FIG. 10.
Figure 12:
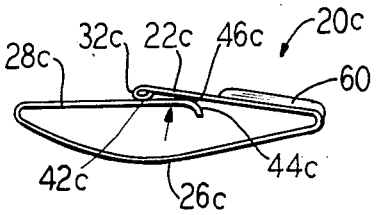
FIG. 12 is an end elevational view of the retainer of FIG. 10 assembled in the "closed" position with the legs acting against each other.

In FIGS. 10, 11 and 12 there is shown an embodiment of the retainer 20*c* which is fabricated of metal, for instance steel. FIG. 10 shows the retainer 20*c* as formed and heat treated and it is seen that the retainer has a first leg 22*c* connected by a bight 24*c* to a back 26*c* and a second leg 28*c* connected by a bight 30*c* to the back 26*c*. The configuration and orientation of the legs and back is very similar to that shown in FIG. 6. An end 32*c* of the first leg 22*c* is rounded over to provide a smooth surface and an end 44*c* of the second leg 28*c* is rounded downwardly.

Stiffening indents or ribs 60 are provided in the first leg 22*c* to assist in enhancing and enforcing the two gripping areas. In a method similar to that described above, the second leg 28*c* is tucked under the first leg 22*c* providing gripping areas at 42*c* and 46*c* as the legs attempt to move toward the positions as they were formed and heat treated. The stiffening indents assist in retaining the memory of the initial position.

Grip area 42*c* is provided where the rounded end 32*c* of the first leg 22*c* overlies the second leg 28*c*. Grip area 46*c* is provided where the downturned end 44*c* of the second leg 28*c* presses against the first leg 22*c*. The rounded ends of the two legs ensure that the sheets of material will be gripped by smooth surfaces to retain the integrity of the sheets without mutilation.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A retainer for use in holding sheets of material comprising:

a retainer body fabricated of a resilient memory-type material having, a back portion, a first leg portion connected by a bight to one edge of said back portion, a second leg portion connected by a bight to an opposite edge of said back portion, said first leg formed at a small acute angle to said back portion and having a length less than the distance between said two edges, said second leg formed at an acute angle to said back portion greater than said small acute angle and having a length less than the distance between said two edges, first and second legs projecting above the same face of said back and the combined length of said legs being greater than the distance between said two edges, said second leg being manipulated to be tucked under said first leg such that said first leg is biased inwardly toward said second leg and second leg is biased outwardly toward said first leg, said first leg having an inwardly projecting lip extending the width of the leg along the end thereof which engages the second leg, and said second leg having an end engagable with said first leg at a point spaced from said lip whereby, gripping action is provided between said first and second legs at two separate places.

2. The device of claim 1 wherein said first leg has an outer surface on which indicia can be placed.

3. The device of claim 1 wherein said back portion has an exposed, relatively planar surface with an adhesive material thereon which can be secured to other planar surfaces.

4. The device of claim 1 wherein said body is fabricated of a plastic material.

5. The device of claim 1 wherein said body is fabricated of a metal material.

6. The device of claim 5 wherein stiffening ribs are formed in said first leg to increase the gripping action of said retainer.

7. A retainer for use in holding sheets of material comprising:

a retainer body fabricated of a resilient memory-type material having, a back portion, a first leg portion connected by a bight to one edge of said back portion, a second leg portion connected by a bight to an opposite edge of said back portion, said first leg formed at a small acute angle to said back portion and having a length less than the distance between said two edges, said second leg formed at an acute angle to said back portion greater than said small acute angle and having a length less than the distance between said two edges, first and second legs projecting above the same face of said back and the combined length of said legs being greater than the distance between said two edges, said second leg being manipulated to be tucked under said first leg such that said first leg is biased inwardly toward said second leg and second leg is biased outwardly toward said first leg, said first leg having an inwardly projecting lip extending the width of the leg along the end thereof which engages the second leg, and said first leg further having two sections, one of which carries said inwardly protruding rounded lip at one end and extends to approximately the line of contact with said second leg and which is of a first thickness, and a second section which is of a first thickness, and a second section which includes the connection to said back and extends to said first section and which is of a greater thickness, whereby, gripping action along the rounded lip is less than the gripping action along the line of contact with said second leg.

8. A retainer for securing sheets of material comprising:

a retainer body having a flat rectangular back segment and two flat rectangular leg segments, the first leg segment connected to said back segment along one edge thereof and said second leg segment connected to said back segment along an opposite edge thereof, said first leg segment overlying a portion of said second leg segment, means biasing said first leg segment against said second leg segment, and means biasing said second leg segment against said first leg segment, said first leg segment having an inwardly projecting terminis extending the width of the leg segment along an end thereof which engages said second leg segment and said second leg segment having an end engagable with said first leg segment, whereby, gripping action is provided at two separate places in the area where said first and second leg portions overlap.

9. The device of claim 8 wherein said biasing means for both leg segments comprises memory in the material of said body urging said leg segments toward a formation orientation in which said second leg segment is formed at a larger angle to said back segment than said first leg segment.

* * * * *